US006203301B1

(12) United States Patent
Kim

(10) Patent No.: US 6,203,301 B1
(45) Date of Patent: Mar. 20, 2001

(54) FLUID PUMP

(76) Inventor: Chun Kyung Kim, Hyundae APT 109/802, Joa-dong, haeundae-ku, Pusan. 612-030 (KR)

( * ) Notice: Subject to any disclaimer, the term of this patent is extended or adjusted under 35 U.S.C. 154(b) by 0 days.

(21) Appl. No.: 09/446,116

(22) PCT Filed: Apr. 29, 1999

(86) PCT No.: PCT/KR99/00208

§ 371 Date: Dec. 27, 1999

§ 102(e) Date: Dec. 27, 1999

(87) PCT Pub. No.: WO99/56020

PCT Pub. Date: Nov. 4, 1999

(30) Foreign Application Priority Data

Apr. 29, 1998 (KR) ..... 98-15231

(51) Int. Cl.[7] ..... F03C 2/00
(52) U.S. Cl. ..... 418/59; 418/6
(58) Field of Search ..... 418/59, 6

(56) References Cited

U.S. PATENT DOCUMENTS

| | | | | |
|---|---|---|---|---|
| 141,226 | * | 7/1873 | Jenkins et al. | 418/59 |
| 300,628 | * | 6/1884 | Nash | 418/59 |
| 493,844 | * | 3/1893 | Schroder | 418/59 |
| 940,817 | * | 11/1909 | McLean et al. | 418/59 |
| 2,073,101 | * | 3/1937 | Fox | 418/59 |
| 2,462,063 | * | 2/1949 | Bergman | 418/59 |
| 2,538,598 | * | 1/1951 | Stratveit | 418/59 |
| 2,561,280 | * | 7/1951 | Kampf | 418/59 |
| 2,649,053 | * | 8/1953 | Stratveit | 418/59 |
| 2,684,036 | * | 7/1954 | Stratveit | 418/59 |
| 2,783,714 | * | 3/1957 | Stratveit | 418/59 |
| 3,125,031 | * | 3/1964 | Rydberg et al. | 418/59 |
| 3,125,032 | * | 3/1964 | Smith | 418/59 |
| 4,526,521 | * | 7/1985 | Siidbeck et al. | 418/59 |
| 4,531,899 | * | 7/1985 | Sudbeck et al. | 418/59 |

FOREIGN PATENT DOCUMENTS

| | | | | |
|---|---|---|---|---|
| 133040 | * | 9/1951 | (DE) | 418/59 |
| 0 085 248 | | 8/1983 | (EP) . | |
| 659495 | * | 10/1951 | (GB) | 418/59 |
| 695392 | * | 8/1953 | (GB) | 418/59 |
| 1160774 | * | 8/1969 | (GB) | 418/59 |
| 498749 | * | 2/1957 | (IT) | 418/59 |
| 58-107886 | * | 6/1983 | (JP) | 418/59 |
| 58-107887 | * | 6/1983 | (JP) | 418/59 |
| 58-107888 | * | 7/1983 | (JP) | 418/549 |

* cited by examiner

*Primary Examiner*—Thomas Denion
*Assistant Examiner*—Theresa Trieu
(74) *Attorney, Agent, or Firm*—Bacon & Thomas PLLC

(57) ABSTRACT

Disclosed is a fluid pump comprising: a camshaft eccentrically connected to a rotating shaft of a motor to be eccentrically rotated by rotation of the motor; a rotor coupled to three crankshafts to revolve along a predetermined orbit by eccentric rotation of the camshaft, the rotor having a concave groove which is formed in a radial direction; an outer casing cooperating with the rotor to define a first fluid chamber between an outer wall of the rotor and the outer casing, the outer casing having a pair of fluid passages which are defined at both sides of a guide bank to allow fluid to be sucked and discharged therethrough, respectively; a side cover coupled to the outer casing to define a body of the fluid pump; an inner casing integrally formed with the side cover, the inner casing cooperating with the rotor to define a second fluid chamber between an inner wall of the rotor and the inner casing; the three crankshafts disposed in the outer casing and locked to the rotor inside of the inner wall of the rotor for controlling eccentricity of the rotor; and the guide bank positioned adjacent an upper portion of the rotor and integrally formed with the outer casing, the guide bank functioning to separate a fluid suction side and a fluid discharge side from each other.

4 Claims, 8 Drawing Sheets

FLUID PUMP

TECHNICAL FIELD

The present invention relates to a fluid pump which is used in various industrial fields.

BACKGROUND ART

Referring to FIG. 10, there are shown cross-sectional views illustrating operations of an oscillating type rotorsco pump of the related art.

As shown, a rotorsco pump includes a camshaft 64 which is eccentrically connected to a rotating shaft 63 of a motor to be eccentrically rotated by rotation of the motor, a rotor 61 which is eccentrically rotated while sliding on an inner wall of an outer casing 62 by rotation of the camshaft 64, and an oscillating shaft 60 which is positioned on a line bisecting the rotor 61 and serves as a centering shaft of the rotor 61.

In operations of the rotorsco pump of the related art, constructed as mentioned above, if the camshaft 64 is eccentrically rotated by the rotation of the motor, the rotor 61 is also eccentrically rotated to compress and discharge fluid. At this time, while an angle formed by the oscillating shaft 60 for one revolution of the rotor 61 is changed from 0 to $\alpha$ or $\beta$, torque is produced at a contact point between the oscillating shaft 60 and the rotor 61. By this, it is difficult to control eccentricity of the rotor 61, and as abrasion of the camshaft 64 and a bearing progresses, friction between the rotor 61 and the inner wall of the outer casing 62 is augmented.

As another fluid pump, a scroll compressor of which the driving type is modified not to rotational reciprocating movement, but to pivoting movement, is disclosed in the art. However, the scroll compressor suffers from defects in that workability is deteriorated because of a complicated scroll curve and a larger fluid capacity cannot be achieved due to a limitation in machining the scroll curve to a sufficient depth. Further, when abrasion of a crankshaft and a bearing is generated, abrasion and fracture are caused between scrolls. Accordingly, because maintenance must be thoroughly carried out, a great deal of effort and time is needed.

DISCLOSURE OF THE INVENTION

Accordingly, the present invention has been made in an effort to solve the problems occurring in the related art, and a primary object of the present invention is to provide an air-cooled fluid pump which reduces friction and noise generated between a rotor and a fixed casing and eliminates the necessity of using lubricant, by decreasing relative velocity of the rotor with respect to the fixed casing.

Another object of the present invention is to provide a fluid pump which accomplishes high efficiency by securing a larger fluid accommodating space.

In order to achieve the above object, according to the present invention, there is provided a fluid pump comprising: a camshaft eccentrically connected to a rotating shaft of a motor to be eccentrically rotated by rotation of the motor; a rotor coupled to three crankshafts to revolve along a predetermined orbit by eccentric rotation of the camshaft, the rotor having a concave groove which is formed in a radial direction; an outer casing cooperating with the rotor to define a first fluid chamber between an outer wall of the rotor and the outer casing, the outer casing having a pair of fluid passages which are defined at both sides of a guide bank to allow fluid to be sucked and discharged therethrough, respectively; a side cover coupled to the outer casing to define a body of the fluid pump; an inner casing integrally formed with the side cover, the inner casing cooperating with the rotor to define a second fluid chamber between an inner wall of the rotor and the inner casing; the three crankshafts disposed in the outer casing and coupled to the rotor inside of the inner wall of the rotor for controlling eccentricity of the rotor; and the guide bank integrally formed with the outer casing, the guide bank functioning to separate a fluid suction side and a fluid discharge side from each other.

While the guide bank has a configuration of a round-head rivet, it can be replaced with another guide bank which has a T or I-shaped configuration.

The guide bank is positioned in the concave groove which is formed in the rotor.

The inner casing is formed in a radial direction with a concave surface which corresponds to a configuration of a free end of the guide bank.

The guide bank functions to guide fluid such that the fluid can be sucked and discharged into and from the first and second fluid chambers defined between the rotor and the casings.

According to another aspect of the present invention, there is provided a fluid pump comprising: a camshaft eccentrically connected to a rotating shaft of a motor to be eccentrically rotated by rotation of the motor; a rotor coupled to three crankshafts to revolve along a predetermined orbit by eccentric rotation of the camshaft, the rotor having a concave surface which is formed in a radial direction; an outer casing cooperating with the rotor to define a fluid chamber between an outer wall of the rotor and the outer casing, the outer casing having a pair of fluid passages which are defined at both sides of a guide bank to allow fluid to be sucked and discharged therethrough, respectively; a side cover coupled to the outer casing to define a body of the fluid pump; the three crankshafts disposed in the outer casing and locked to the rotor inside of the inner wall of the rotor for controlling eccentricity of the rotor; and the guide bank integrally formed with the outer casing, the guide bank functioning to separate a fluid suction side and a fluid discharge side from each other.

The guide bank functions to guide fluid such that the fluid between the rotor and the outer casing can be sucked and discharged.

The guide bank is positioned in the concave surface which is formed in the rotor.

BRIEF DESCRIPTION OF THE DRAWINGS

The above objects, and other features and advantages of the present invention will become more apparent after a reading of the following detailed description when taken in conjunction with the drawings, in which.

BEST MODE FOR CARRYING OUT THE INVENTION

Figure 1:
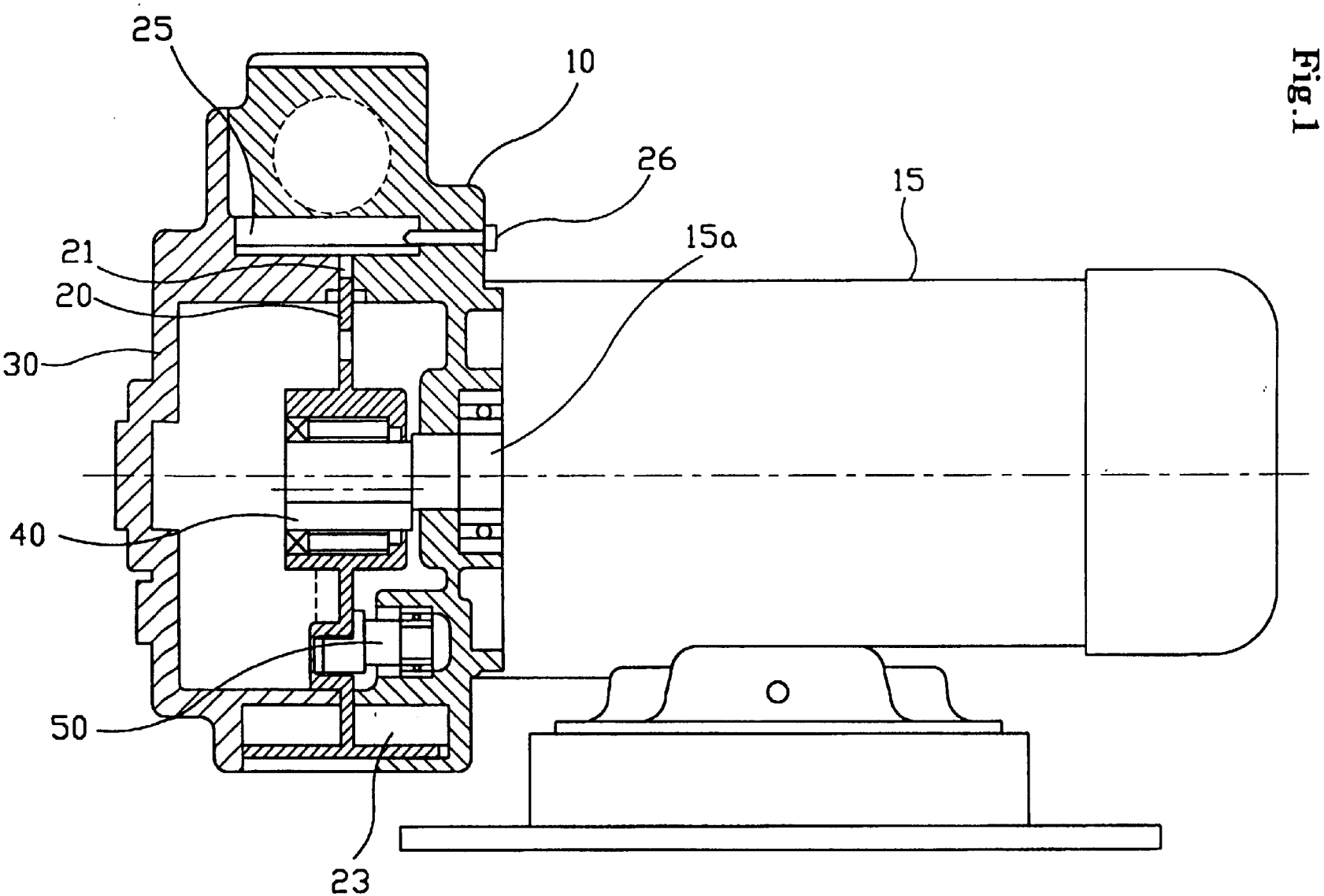
FIG. 1 is a side cross-sectional view of a fluid pump in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
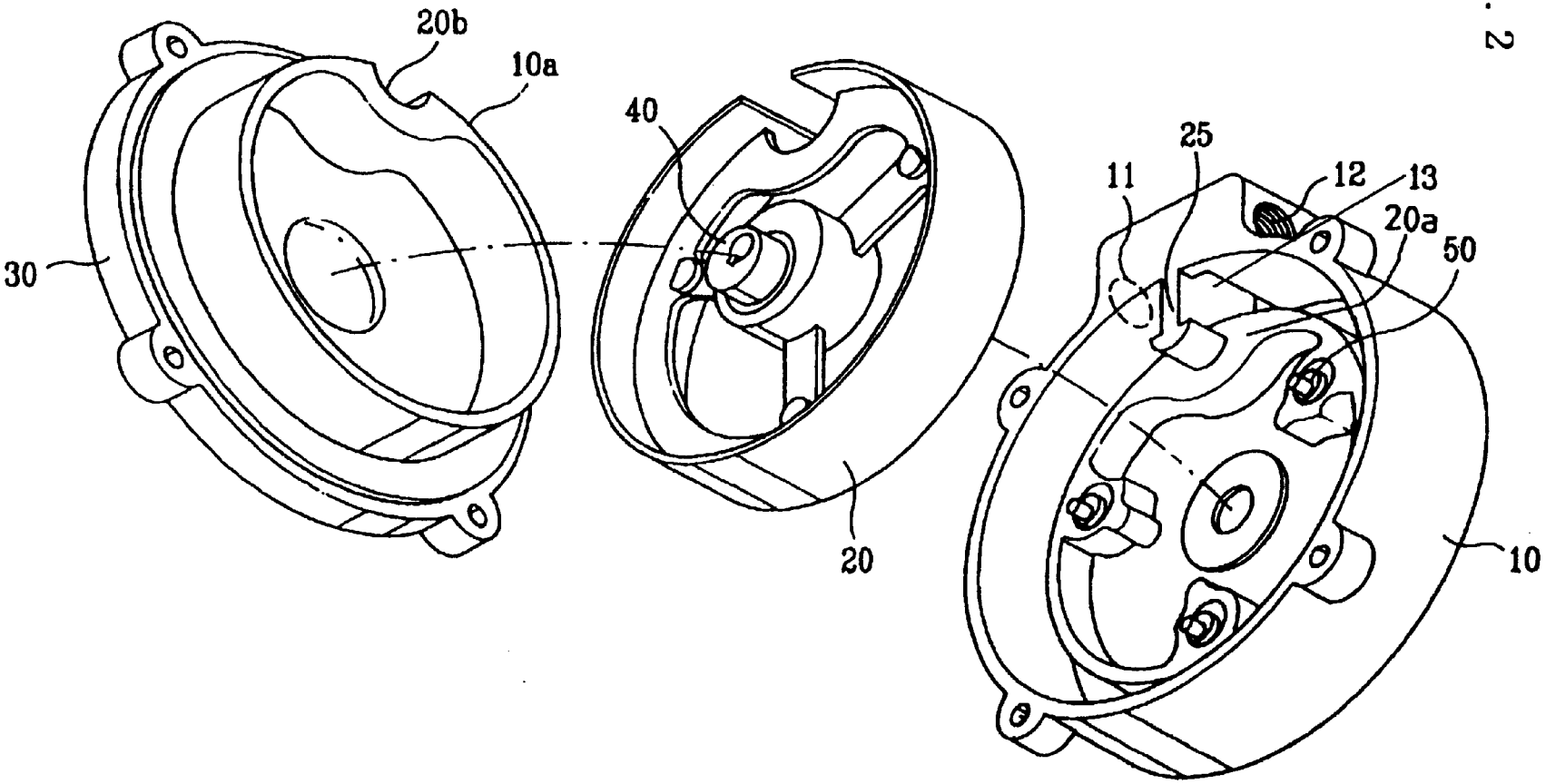
FIG. 2 is an exploded perspective view of the fluid pump of FIG. 1.
Figure 3:
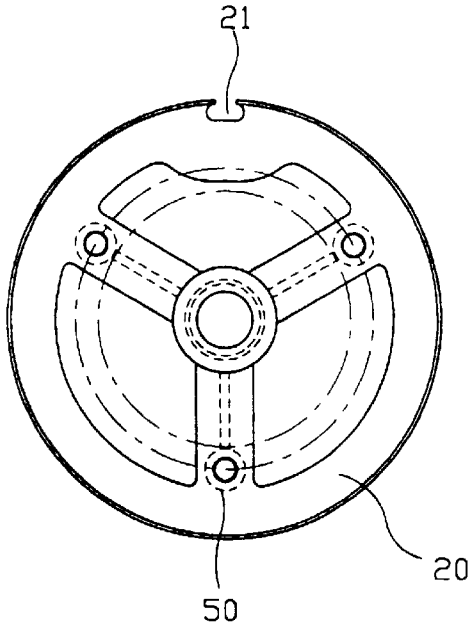
FIG. 3 is a front cross-sectional view of a rotor according to the present invention.

Referring to FIGS. 1 and 2, there is shown a fluid pump according to the present invention.

As shown, a fluid pump includes a camshaft 40 which is eccentrically connected to a rotating shaft 15*a* of a motor 15 to be eccentrically rotated by rotation of the motor 15; a rotor 20 which is coupled to three crankshafts 50 to revolve along a predetermined orbit by eccentric rotation of the camshaft 40 and has a concave groove 21 formed in a radial direction; and a guide bank 25 which is positioned in the radially formed concave groove 21 of the rotor 20 and is integrally formed with an outer casing 10 functioning to separate a fluid suction side and a fluid discharge side from each other. Here, while the guide bank 25 has a configuration of a round-head rivet, it can be replaced with another guide bank which has a T or I-shaped configuration.

The three crankshafts 50 are disposed in the outer casing 10 to provide the rotor 20 with a stable eccentric rotation.

The rotor 20 is formed with the concave groove 21 in the radial direction. An inner casing 10*a* is overlapped on one side of the rotor 20 to be loosely inserted into an upper part of the rotor 20, and the outer casing 10 is underlapped on the other side the rotor 20 to be loosely fitted around a lower part of the rotor 20. At this time, due to the fact that the inner casing 10*a* is formed with a concave surface 20*b* band the outer casing 10 is formed with a concave surface 20*a,* a third fluid chamber 24 having a simple elliptical configuration is defined by the rotor 20, the inner casing 10*a* and the outer casing 10.

The outer casing 10 is formed with a pair of fluid passages 13 which are defined at both sides of the guide bank 25 to allow fluid to be sucked and discharged therethrough, respectively. An inner wall of the outer casing 10 is formed to have a simple concentric circle curve in view of easiness in shaping such that it corresponds to a configuration of the rotor 20. A first fluid chamber 22 is defined between the inner wall of the outer casing 10 and an outer wall of the rotor 20.

Also, the inner casing 10*a* is integrally formed with a side cover 30 which is coupled to the outer casing 10 to define a body of the fluid pump. Outside the inner casing 10*a,* a second fluid chamber 23 is defined between an inner wall of the rotor 20 and an outer wall of the inner casing 10*a*.

The outer wall of the inner casing 10*a* is formed to have a simple concentric circle curve in view of easiness in shaping such that it corresponds to the configuration of the rotor 20. The inner casing 10*a* is formed in a radial direction with the concave surface 20*b* to be matched with the round-head configuration of a free end of the guide bank 25.

Figure 6:
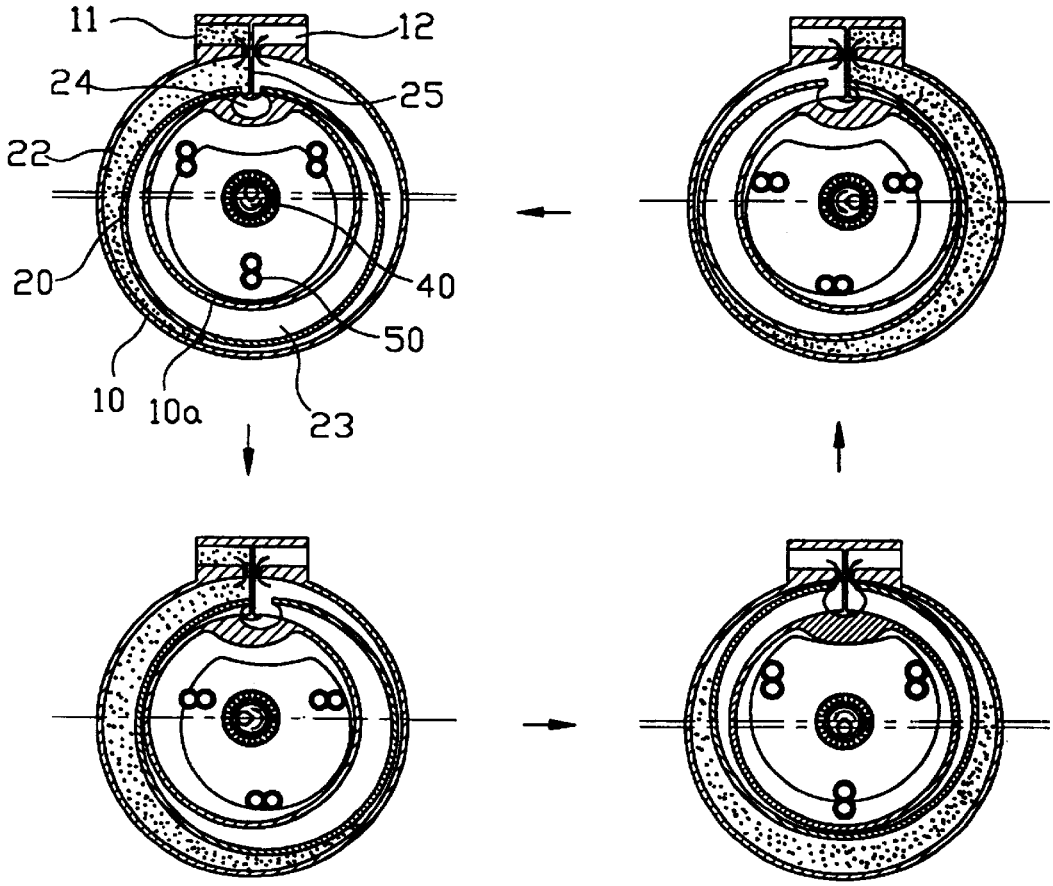
FIG. 6 is of cross-sectional views illustrating fluid flow between the rotor and an outer casing according to the present invention.

The guide bank 25 functions, as shown in FIG. 6, to cause fluid to be sucked and discharged into and from the third fluid chamber 24 which is defined between the radially formed concave groove 21 of the rotor 20, the outer casing 10 and the inner casing 10*a*.

Further, the guide bank 25 functions to cause fluid to be sucked and discharged into and from the first fluid chamber 22 which is defined between the rotor 20 and the outer casing 10.

Moreover, the guide bank 25 functions to cause fluid to be sucked and discharged into and from the second fluid chamber 23 which is defined between the rotor 20 and the inner casing 10*a*.

Hereinafter, operations of the fluid pump according to the present embodiment, constructed as mentioned above, will be described with reference to the drawings.

FIG. 6 illustrates suction, compression and discharge strokes of fluid between the outer casing 10 and the rotor 20. If the camshaft 40 which is eccentrically connected to the rotating shaft 15*a* of the motor 15 is eccentrically rotated in a direction shown by an arrow, the rotor 20 revolves in a state wherein it is locked to the three crankshafts 50. More particularly, the rotor 20 revolves along the inner wall of the outer casing 10, as in an orbit, in a state wherein it is captured by the three crankshafts 50. In this case, the inner wall of the outer casing 10 and the outer wall of the rotor 20 do not come into contact with each other, and move relative to each other while maintaining a fine gap therebetween.

Accordingly, if fluid is sucked through a suction port 11 into the first fluid chamber 22 which is defined between the outer casing 10 and the rotor 20, a series of processes for sucking, compressing, expanding and discharging the fluid are repeated by the revolution of the rotor 20 along the orbit, whereby the fluid is caused to flow.

Figure 7:
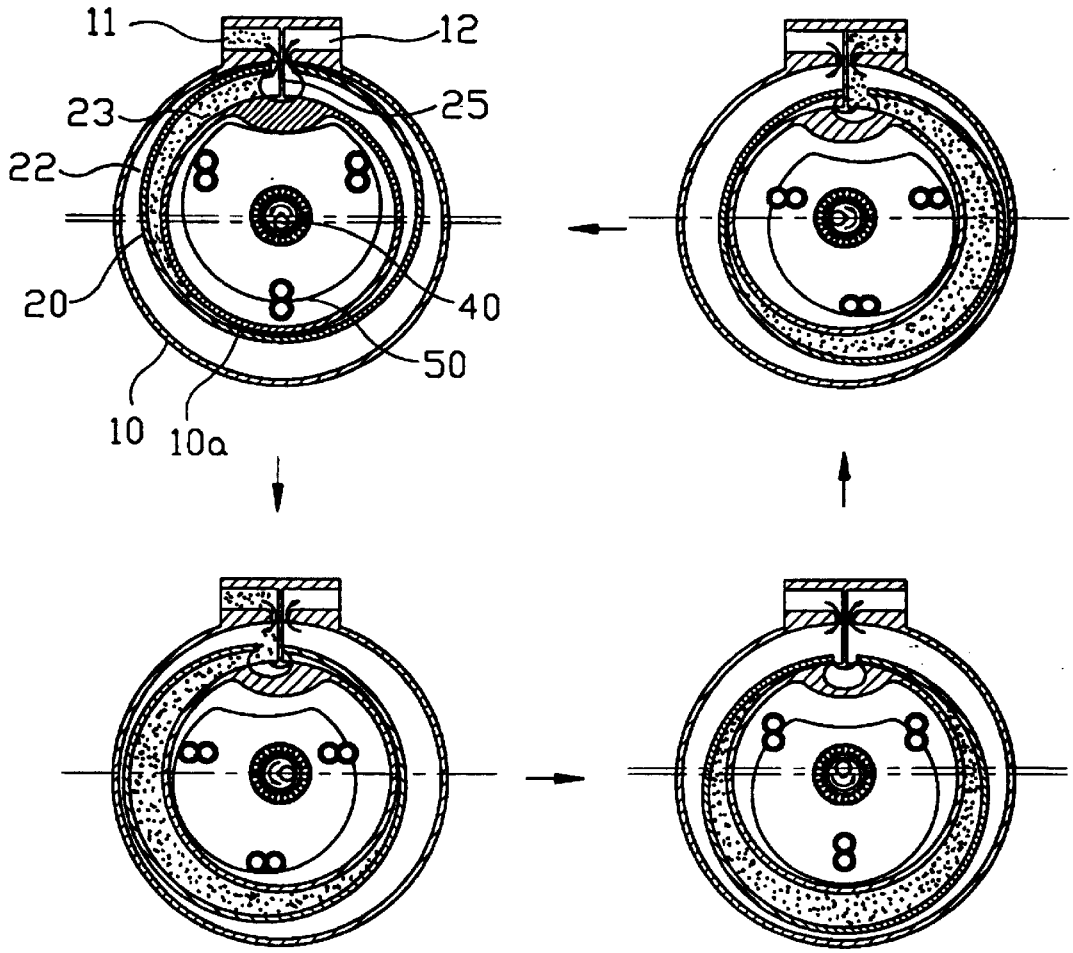
FIG. 7 is of cross-sectional views illustrating fluid flow between the rotor and an inner casing according to the present invention.

In addition, FIG. 7 illustrates fluid flow between the rotor 20 and the inner casing 10*a*. Of course, here, similarly to the case of FIG. 5, if the camshaft 40 is eccentrically rotated by rotation of the rotating shaft 15*a* of the motor 15, the rotor 20 revolves along the orbit in a state wherein it is captured by the three crankshafts 50. Accordingly, if fluid is sucked into the second fluid chamber 23 which is defined between the rotor 20 and the inner casing 10*a,* fluid is repeatedly sucked, compressed, expanded and discharged, by the revolution of rotor 20.

The series of processes for sucking, compressing and discharging fluid are concurrently and mutually complementarily implemented in FIGS. 6 and 7.

To be more detailed, as an example, when fluid is sucked into the first fluid chamber 22 which is defined between the outer casing 10 and the rotor 20, fluid being in the second fluid chamber 23 which is defined between the rotor 20 and the inner casing 10*a,* is discharged through a discharge port 12.

Also, if fluid being in the first fluid chamber 22 which is defined between the outer casing 10 and the rotor 20, is in the process of being discharged, fluid is sucked into the second fluid chamber 23 which is defined between the rotor 20 and the inner casing 10*a*.

Figure 8:
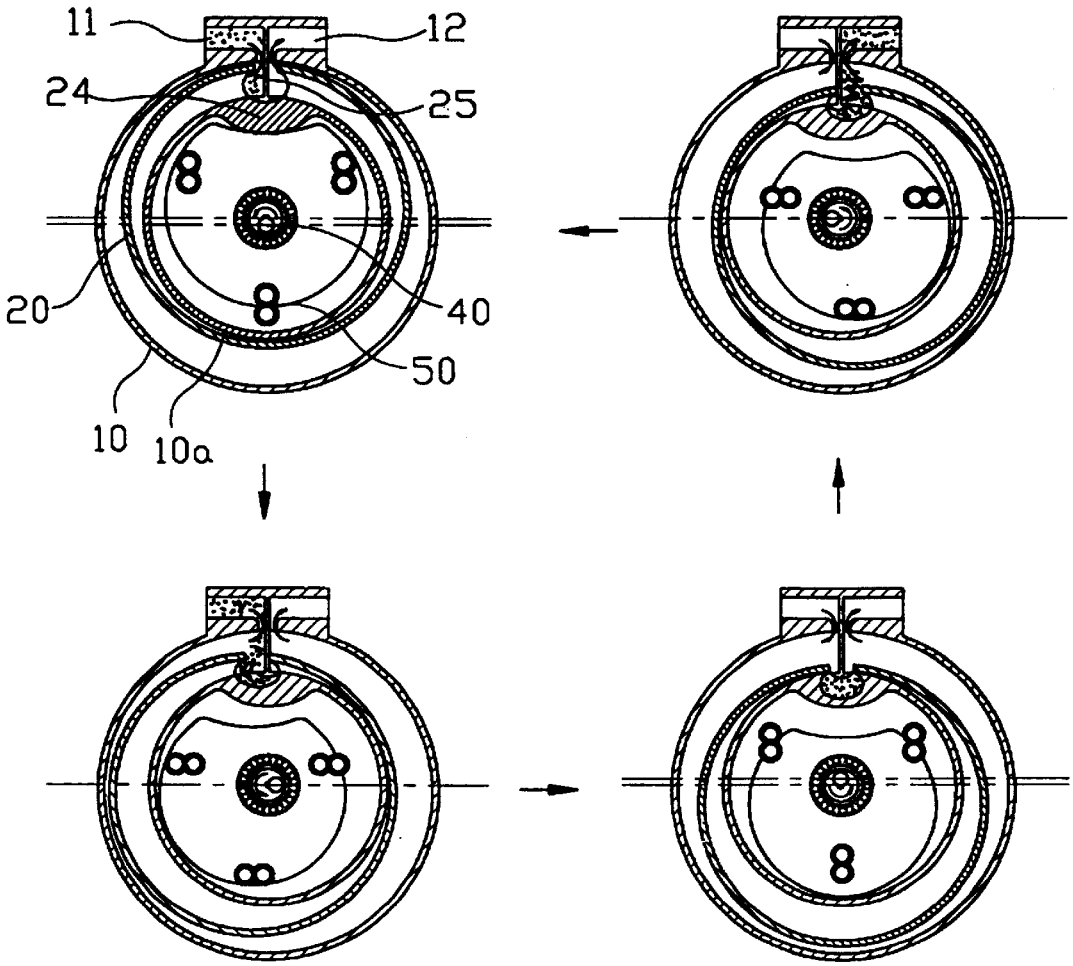
FIG. 8 is of cross-sectional views illustrating fluid flow in a fluid chamber which is defined among the rotor, the inner casing and the outer casing, according to the present invention.

FIG. 8 illustrates fluid flow in the third fluid chamber 24 which is defined adjacent an upper portion of the rotor 20 and has the elliptical configuration. Of course, here, if the rotor 20 revolves along the orbit, processes in which fluid is sucked and discharged into and from the third fluid chamber 24 at both sides of the guide bank 25, are repeated.

As described above, in addition to the first fluid chamber 22 which is defined between the inner wall of the outer casing 10 and the outer wall of the rotor 20 and the second fluid chamber 23 which is defined between the inner wall of the rotor 20 and the outer wall of the inner casing 10*a* as shown in FIGS. 6 and 7, because the third fluid chamber 24 is defined by the fact that the concave groove 21 radially formed adjacent the upper portion of rotor 20 is surrounded by the outer casing 10, the guide bank 25 and the inner casing 10*a* as shown in FIG. 8, a larger fluid accommodating space is secured by the present invention.

Moreover, due to the fact that the inner wall of the outer casing 10, the outer wall of the inner casing 10*a* and the inner and outer walls of the rotor 20 are formed to have substantially similar concentric circle curves, since face contacts rather than line contacts are realized by the present invention, it is possible to prevent fluid from flowing reversely. Also, when considering the fact that friction of the rotor 20 with the outer casing 10 and the inner casing 10*a* is related with the eccentricity thereof, the three crankshafts 50 can reduce the friction by causing the rotor 20 to stably revolve along the orbit, and by this revolving mechanism, velocity of the rotor 20 relative to the outer casing, that is, the fixed casing 10 can be decreased thereby to eliminate the necessity for a lubricating operation for cooling frictional heat, whereby conveying of clean fluid can be effected.

Figure 4:
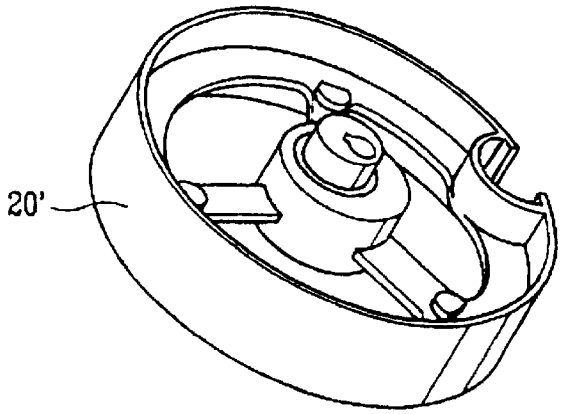
FIG. 4 is a perspective view of another rotor which is formed with a concave surface in a radial direction, according to the present invention.
Figure 5:
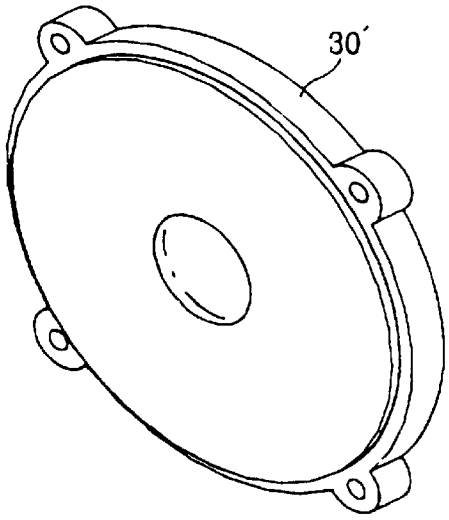
FIG. 5 is a perspective view of a side cover which does not have an inner casing, according to the present invention.
Figure 9:
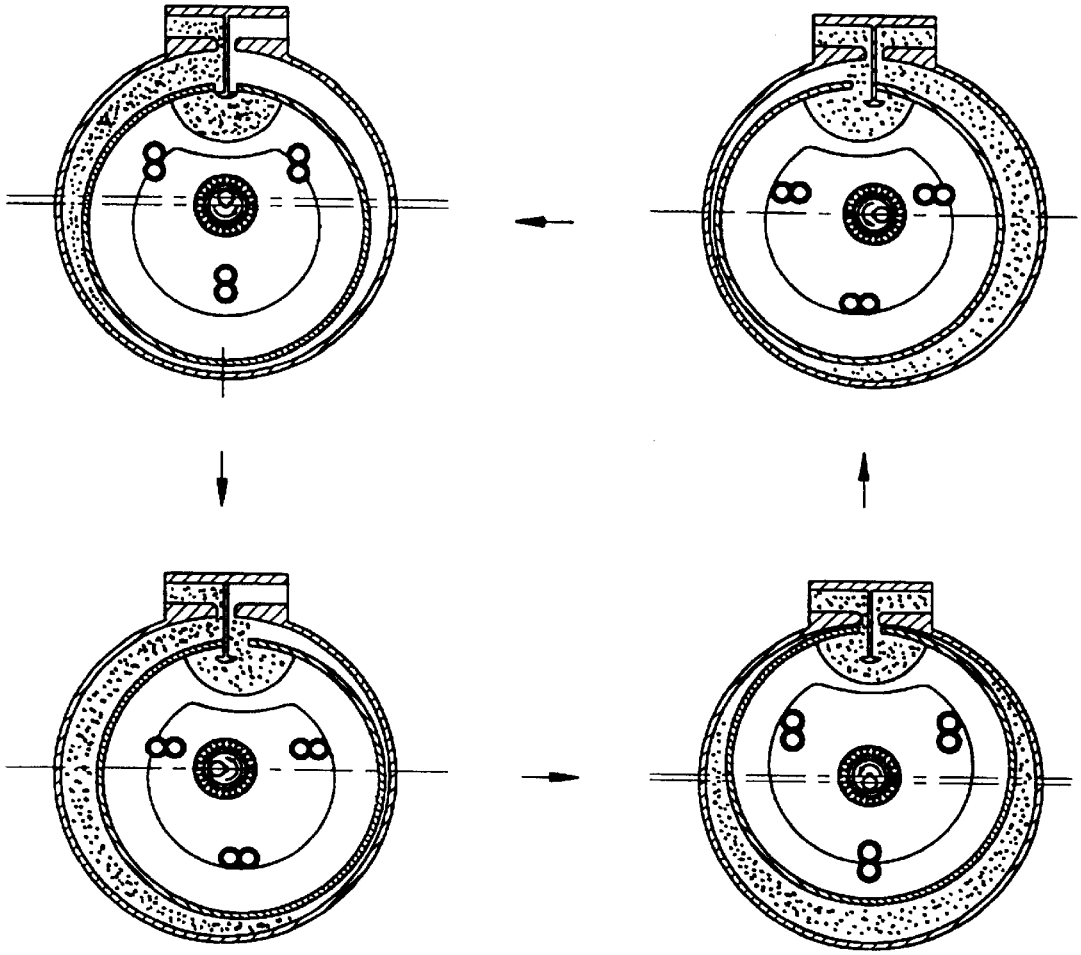
FIG. 9 is of cross-sectional views illustrating fluid flow in accordance with another embodiment of the present invention.
Figure 10:
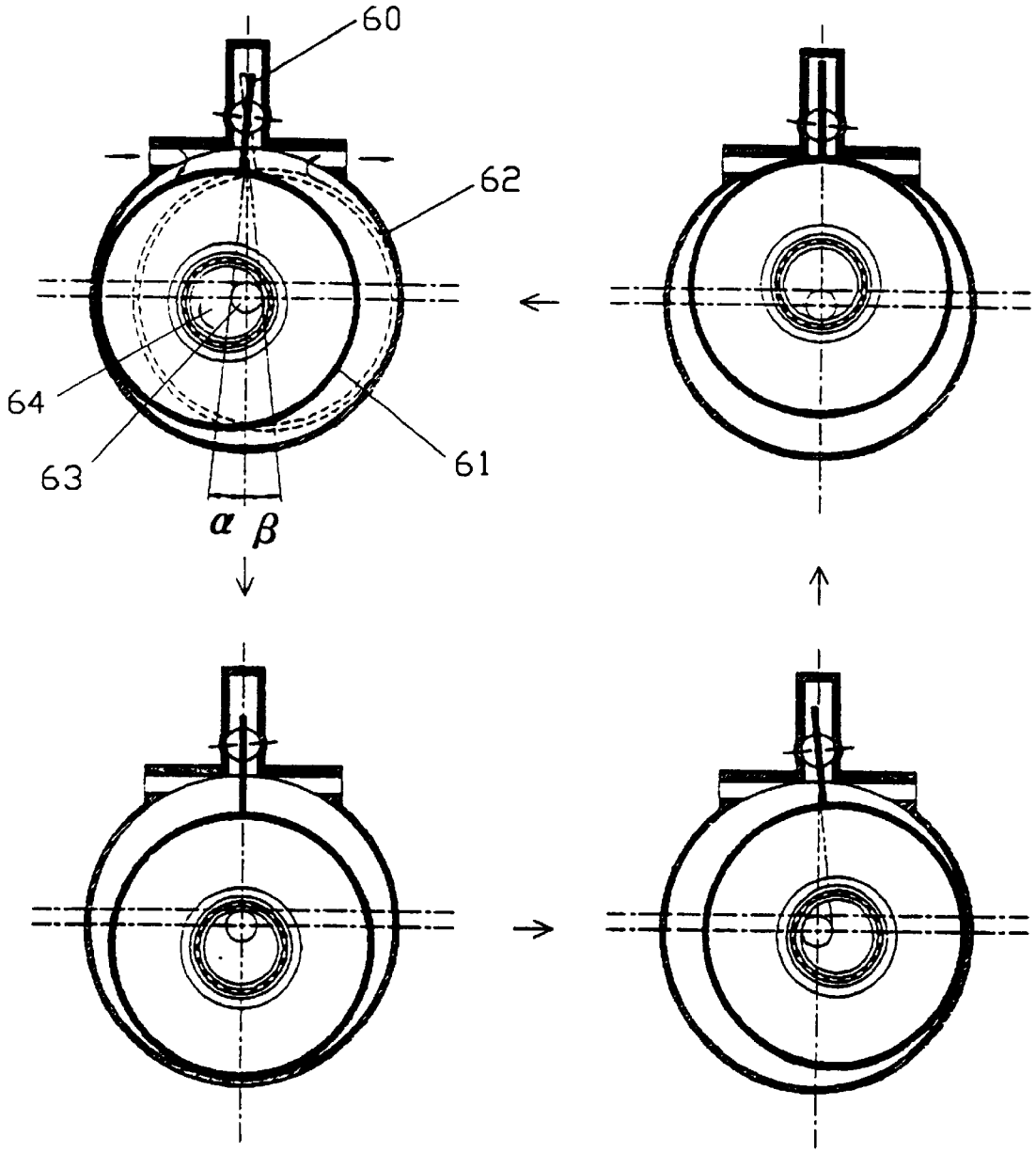
Fig. 10 (PRIOR ART)
FIG. 10 is of cross-sectional views illustrating operations of an oscillating type rotorsco pump of the related art.

In another embodiment of the present invention, as shown in FIG. 5, a side cover 30' is not provided with the inner casing 10*a* of the first embodiment, not to define the second fluid chamber inside the rotor 20. In other words, a fluid pump of the present embodiment is constructed by substituting the rotor 20 of FIG. 2 and the side cover 30 of FIG. 2 with a rotor 20' of FIG. 4 and the side cover 30' of FIG. 5, respectively. Operations of the fluid pump according to the present embodiment is as illustrated in FIG. 9. Featuring characteristics of this embodiment are in that since the inner casing 10*a* is not provided not to define the second fluid chamber 23, volume of a fluid chamber can be increased due to the fact that the concave surface 20*b* of the inner casing 10*a* is unnecessary, and a structure is simplified.

INDUSTRIAL APPLICABILITY

The fluid pump according to the present invention achieves working effects as described below.

First, since a guide bank is fixed to an upper end of an outer casing and the outer casing and an inner casing are disposed outside and inside a rotor, respectively, a larger fluid accommodating space can be secured, whereby it is possible to obtain pumping effect of high efficiency.

Second, due to the fact that the rotor stably revolves along an orbit in a state wherein it is captured by crankshafts, friction between the casings and the rotor can be reduced, thereby to eliminate the necessity for a lubricating operation for cooling frictional heat, whereby conveying of clean fluid can be effected.

Third, since revolving velocity of the rotor is kept constant, generation of pulsation is lessened.

Fourth, since a structure of the fluid pump is simplified, it can be easily fabricated, operational failure rate is decreased, and maintenance can be conveniently performed.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A fluid pump comprising:

a camshaft eccentrically connected to a rotating shaft of a motor to be eccentrically rotated by rotation of the motor;

three crankshafts disposed in an outer casing and locked to a rotor inside of an inner wall of the rotor for controlling eccentricity of the rotor;

the rotor coupled to the three crankshafts to revolve along a predetermined orbit by eccentric rotation of the camshaft, the rotor having a concave surface which is formed such that a guide bank is positioned in an elliptical groove of the rotor;

the guide bank positioned adjacent an upper portion of the rotor and integrally formed with the outer casing, the guide bank functioning to separate a fluid suction side and a fluid discharge side from each other;

the outer casing cooperating with the rotor to define a first fluid chamber between an outer wall of the rotor and the outer casing, the outer casing having a pair of fluid passages which are defined at both sides of the guide bank to allow fluid to be sucked and discharged therethrough, respectively;

a side cover coupled to the outer casing to define a body of the fluid pump; and an inner casing integrally formed with the side cover, the inner casing cooperating with the rotor to define a second fluid chamber between the inner wall of the rotor and the inner casing.

2. A fluid pump as claimed in claim 1, wherein the guide bank has a configuration of a round-head rivet such that fluid can be sucked and discharged into and from the first fluid chamber defined between the rotor and the outer casing and into and from the second fluid chamber defined between the rotor and the inner casing.

3. A fluid pump comprising:

a camshaft eccentrically connected to a rotating shaft of a motor to be eccentrically rotated by rotation of the motor;

three crankshafts disposed in an outer casing and locked to a rotor inside of an inner wall of the rotor for controlling eccentricity of the rotor;

the rotor coupled to the three crankshafts to revolve along a predetermined orbit by eccentric rotation of the camshaft, the rotor having a concave surface which is formed in a radial direction such that a guide bank is positioned in an elliptical groove of the rotor;

the guide bank positioned adjacent an upper portion of the rotor and integrally formed with the outer casing, the guide bank functioning to separate a fluid suction side and a fluid discharge side from each other;

the outer casing cooperating with the rotor to define a fluid chamber between an outer wall of the rotor and the outer casing, the outer casing having a pair of fluid passages which are defined at both sides of the guide bank to allow fluid to be sucked and discharged therethrough, respectively; and a side cover coupled to the outer casing to define a body of the fluid pump.

4. A fluid pump as claimed in claim 3, wherein the guide bank has a configuration of around-head rivet such that fluid can be sucked and discharged into and from the fluid chamber defined between the rotor and the outer casing.

* * * * *